US008147982B2

(12) United States Patent
Schlichting et al.

(10) Patent No.: US 8,147,982 B2
(45) Date of Patent: Apr. 3, 2012

(54) POROUS PROTECTIVE COATING FOR TURBINE ENGINE COMPONENTS

(75) Inventors: Kevin W. Schlichting, Storrs, CT (US); Melvin Freling, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 908 days.

(21) Appl. No.: 12/002,842

(22) Filed: Dec. 19, 2007

(65) Prior Publication Data

US 2011/0305892 A1 Dec. 15, 2011

(51) Int. Cl.
*B32B 15/00* (2006.01)

(52) U.S. Cl. ..... 428/632; 428/613; 428/617; 428/699; 428/701; 428/702; 416/241 R

(58) Field of Classification Search ..... None
See application file for complete search history.

(56) References Cited

U.S. PATENT DOCUMENTS

| | | | | |
|---|---|---|---|---|
| 3,956,531 | A | 5/1976 | Church et al. | |
| 4,481,237 | A | 11/1984 | Bosshart et al. | |
| 4,595,637 | A | 6/1986 | Eaton et al. | |
| 5,633,081 | A | 5/1997 | Clough et al. | |
| 6,365,222 | B1 | 4/2002 | Wagner et al. | |
| 6,410,159 | B1 * | 6/2002 | Hermanek | 428/570 |
| 6,637,643 | B2 | 10/2003 | Hasz et al. | |
| 6,641,907 | B1 | 11/2003 | Merrill et al. | |
| 6,660,405 | B2 | 12/2003 | Lau et al. | |
| 6,730,422 | B2 | 5/2004 | Litton et al. | |
| 7,198,462 | B2 | 4/2007 | Merrill et al. | |
| 2003/0049470 | A1 * | 3/2003 | Maloney | 428/472 |
| 2004/0137259 | A1 | 7/2004 | Pabla et al. | |
| 2006/0216428 | A1 | 9/2006 | DeBiccari et al. | |
| 2007/0098913 | A1 | 5/2007 | Raybould et al. | |
| 2007/0138019 | A1 | 6/2007 | Kasule | |

FOREIGN PATENT DOCUMENTS

| | | | |
|---|---|---|---|
| DE | 102005045241 | A1 | 3/2007 |
| EP | 1382707 | A1 | 1/2004 |
| EP | 1897972 | A1 | 3/2008 |
| WO | W02005/078150 | A1 | 8/2005 |

OTHER PUBLICATIONS

European Search Report, mailed Feb. 11, 2011.

* cited by examiner

*Primary Examiner* — Ling Xu
(74) *Attorney, Agent, or Firm* — Kinney & Lange, P.A.

(57) ABSTRACT

A method for coating a substrate of a turbine engine component, the method comprising cold spray depositing a metal-based material onto a surface of the substrate, and heating the deposited metal-based material to increase the porosity of the deposited metal-based material.

13 Claims, 3 Drawing Sheets

POROUS PROTECTIVE COATING FOR TURBINE ENGINE COMPONENTS

BACKGROUND

The present invention relates to protective coatings for turbine engine components, such as aerospace components. In particular, the present invention relates to methods for forming coatings that provide oxidation resistance to turbine engine components.

A gas turbine engine typically consists of an inlet, a compressor, a combustor, a turbine, and an exhaust duct. The compressor draws in ambient air and increases its temperature and pressure. Fuel is added to the compressed air in the combustor, where it is burned to raise gas temperature, thereby imparting energy to the gas stream. To increase gas turbine engine efficiency, it is desirable to increase the temperature of the gas entering the turbine stages. This requires the first stage turbine engine components (e.g., vanes and blades) to be able to withstand the thermal and oxidation conditions of the high temperature combustion gas during the course of operation.

To protect turbine engine components from the extreme conditions, such components typically include metallic coatings (e.g., aluminide and MCrAlY coatings) that provide oxidation and/or corrosion resistance. The metallic coatings may also function as bond coats to adhere thermal barrier coatings to the substrates of the turbine engine components. Existing bond coats are applied to turbine engine components using a variety of deposition techniques (e.g., plasma spraying, cathodic arc, pack cementation, and chemical vapor deposition techniques). The ceramic thermal barrier coatings are then applied over the bond coats to thermally insulate the turbine engine component from the extreme operating conditions. However, over the course of operation, the thermal barrier coatings may be worn away (e.g., spalling and abrasive removals), thereby exposing the bond coats and the underlying substrates of the turbine engine components to the high operating temperatures. This exposure can eventually result in thermal degradation of the turbine engine component, which correspondingly may reduce operational efficiencies of the gas turbine engine.

SUMMARY

The present invention relates to a method for coating a substrate of a turbine engine component. The method includes depositing a metal-based material onto a surface of the substrate with a cold spray process using a carrier gas, where a portion of the carrier gas is entrained within the deposited metal-based material. The method further includes heating the deposited metal-based material to diffuse the entrained carrier gas through the deposited metal-based material, thereby increasing the porosity of the deposited metal-based material.

DETAILED DESCRIPTION

Figure 1:
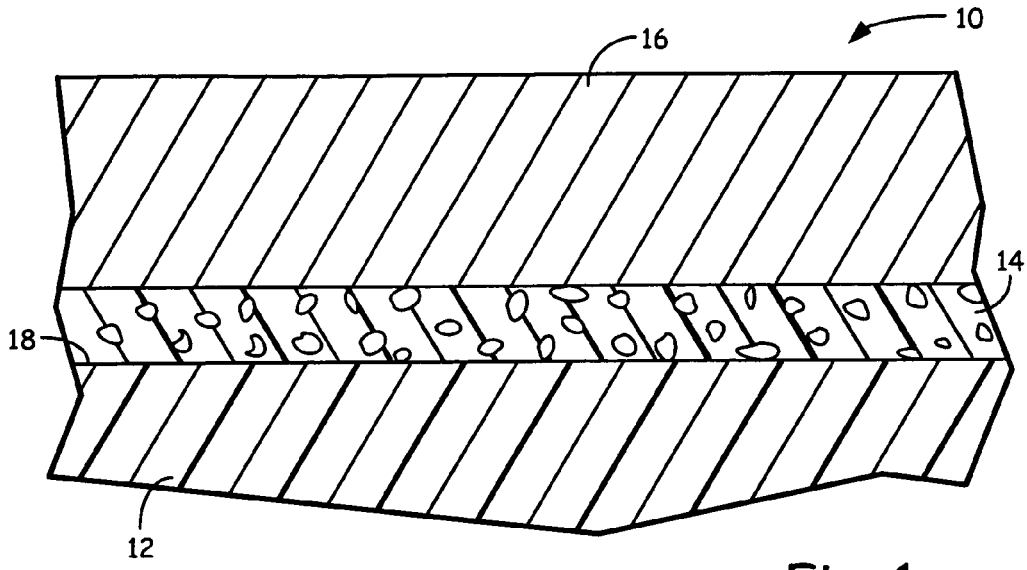
FIG. 1 is a sectional view of a turbine engine component including a porous bond coat and a thermal barrier coating.

FIG. 1 is a sectional view of turbine engine component 10, which includes substrate 12, bond coat 14, and thermal barrier coating 16. Substrate 12 is a base portion of a turbine engine component, such as an airfoil portion of a turbine blade or vane, and includes surface 18. Suitable materials for substrate 12 may depend on the function of turbine engine component 10. For example, for components that are subjected to high temperatures and pressures of a high pressure turbine stage (e.g., turbine blades and vanes), suitable materials for substrate 12 include superalloys having directionally-solidified or single-crystal microstructures. Examples of suitable materials for substrate 12 include nickel-based superalloys, cobalt-based superalloys, and combinations thereof; and may also include one or more additional materials such as titanium, chromium, niobium, hafnium, tantalum, molybdenum, tungsten, aluminum, carbon, and iron.

Bond coat 14 is a porous metallic coating formed on surface 18 with a cold spray process and a heat treatment process, where the heat treatment process occurs prior to the formation of thermal barrier coating 16. As discussed below, the porosity of bond coat 14 reduces its thermal conductivity, which correspondingly reduces the heat transfer rate across bond coat 14 during the course of operation in a gas turbine engine. Examples of suitable levels of porosity in bond coat 14 range from about 20% by volume of bond coat 14 to about 50% by volume of bond coat 14, with particularly suitable levels of porosity ranging from about 25% by volume of bond coat 14 to about 45% by volume of bond coat 14, and with even more particularly suitable levels of porosity ranging from about 30% by volume of bond coat 14 to about 40% by volume of bond coat 14. Levels of porosity greater than about 50% by volume of bond coat 14 reduce the structural integrity of bond coat 14, and may also reduce the oxidation resistance of bond coat 14. Alternatively, levels of porosity less than about 20% by volume of bond coat 14 do not provide significant decreases in the thermal conductivity of bond coat 14. Thus, the suitable levels of porosity for bond coat 14 provide a balance between the desired properties of bond coat 14.

Bond coat 14 may be formed from a variety of metal-based materials that are suitable for providing oxidation and/or corrosion resistance to substrate 12. Examples of suitable materials for forming bond coat 14 include aluminum, transition metals (e.g., platinum, palladium, rhodium, and iridium), MCrAlY materials, and combinations thereof. For MCrAlY materials, "M" is nickel, cobalt, or a combination of nickel and cobalt (e.g., NiCrAlY, CoCrAlY, and NiCoCrAlY). Examples of suitable compositions for the MCrAlY materials include chromium concentrations ranging from about 4% by weight to about 25% by weight, aluminum concentrations ranging from about 5% by weight to about 20% by weight, yttrium concentrations ranging from about 0.1% by weight to about 2.0% by weight, and the balance being nickel and/or cobalt. The MCrAlY material may also include one or more additive materials such as hafnium, silicon, tantalum, tungsten, rhenium, zirconium, niobium, titanium, and molybdenum. Examples of suitable coating thicknesses for bond coat 14 range from about 50 micrometers to about 500 micrometers, with particularly suitable coating thicknesses ranging from about 200 micrometers to about 400 micrometers.

Thermal barrier coating 16 is a ceramic coating that thermally insulates substrate 10 during the course of operation in a gas turbine engine. Suitable materials for thermal barrier coating 16 include zirconia-based materials, where the zirconia is desirably modified with a stabilizer to prevent the formation of a monoclinic phase. Examples of suitable stabilizers include yttria, calcia, ceria, magnesia, and combinations thereof. Thermal barrier coating 16 may be formed on bond coat 14 using a variety of deposition techniques, such as electron beam-physical vapor deposition (EB-PVD), plasma spray, chemical vapor deposition, and cathodic arc deposition. Examples of suitable coating thicknesses for thermal barrier coating 16 range from about 25 micrometers to about 1,000 micrometers, with particularly suitable coating thicknesses ranging from about 100 micrometers to about 500 micrometers.

During operation in a gas turbine engine, turbine engine component 10 may be exposed to extreme temperatures and pressures, particularly if turbine engine component 10 is a component of a high pressure turbine stage. Exposure to these extreme conditions eventually cause successive portions of thermal barrier coating 16 to wear away due to spalling and/or abrasive conditions. As greater amounts of thermal barrier coating 16 are worn away, the level of thermal resistance obtained by thermal barrier coating 16 correspondingly reduces. This subjects substrate 12 and bond coat 14 to continually greater temperatures. If substantial portions of thermal barrier coating 16 are removed during operation, the temperatures that bond coat 14 is exposed to may be great enough to thermally degrade substrate 12. However, the porosity of bond coat 14 reduces the thermal conductivity of bond coat 14, thereby reducing the amount of thermal energy transferred to substrate 12. This correspondingly reduces the amount of thermal degradation that substrate 12 undergoes, thereby extending the service life of turbine engine component 10. Additionally, despite the porosity, bond coat 14 retains about 85% to about 90% of the oxidation resistance exhibited by a substantially non-porous bond coat having the same composition. As such, bond coat 14 may also continue to protect substrate 12 against oxidation during the course of operation.

Figure 2:
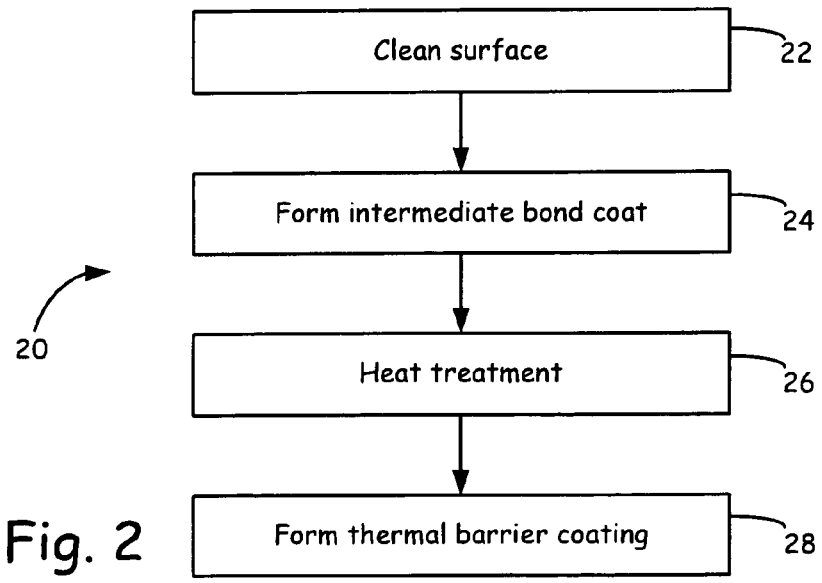
FIG. 2 is a flow diagram of a method for forming a porous bond coat and a thermal barrier coating on a turbine engine component, where the bond coat is rendered porous prior to forming the thermal barrier coating.

FIG. 2 is a flow diagram of method 20 for forming a porous bond coat on a turbine engine component. The following discussion of method 20 is made with reference to turbine engine component 10 (shown in FIG. 1) with the understanding that method 20 is suitable for use in coating a variety of different turbine engine components. As shown, method 20 includes step 22-28, and initially involves cleaning surface 18 of turbine engine component 10 (step 22). Surface 18 is desirably cleaned to remove any potential impurities located on surface 18. Examples of suitable cleaning techniques for step 22 include fluoride-ion treatments with hydrogen fluoride gas. In one embodiment, method 20 is a restoration process, where substrate 12 is an engine-run component that has undergone repair and requires a replacement coating. In this embodiment, surface 18 may be a restored region of substrate 12.

After surface 18 is cleaned, bond coat 14 is then formed on surface 18 with a cold spray process (step 24). The cold spray process deposits a powder material onto surface 18 with the use of a carrier gas under high pressures, thereby plastically deforming the particles of the powder material in a solid state manner. This bonds the powder material to surface 16 of turbine engine component 10 to form an intermediate bond coat. An example of a suitable cold spray system for depositing the powder material is disclosed in DeBiccari et al., U.S. Application Publication No. 2006/0216428. Suitable materials for the powder material include the metal-based materials discussed above for bond coat 14 (e.g., MCrAlY materials). Examples of suitable average particle sizes for the powder material include sizes of about 50 micrometers or less, with particularly suitable average particle sizes ranging from about 5 micrometers to about 20 micrometers.

Suitable carrier gases for use in the cold spray process include non-oxidizing, inert gases, such as helium, nitrogen, argon, and combinations thereof. Suitable pressures for the cold spray process include pressures of at least about 1.4 megapascals (about 200 pounds/square-inch (psi)), with particularly suitable pressures ranging from about 2.1 megapascals (about 300 psi) to about 3.4 megapascals (about 500 psi). In one embodiment, the carrier gas is heated to assist the deposition process, where the temperature of the heated carrier gas is lower than a melting temperature of the powder material. Examples of suitable temperatures for the carrier gas range from about 320° C. (about 600° F.) to about 650° C. (about 1,200° F.), with particularly suitable temperatures ranging from about 370° C. (about 700° F.) to about 540° C. (about 1000° F.). Upon being deposited with the cold spray process, the deposited material provides a dense, intermediate bond coat containing small pockets of the carrier gas entrained within a matrix of the deposited material. Accordingly, the intermediate bond coat has a porosity level of less than about 5% by volume of the entire intermediate bond coat.

Substrate 12 with the intermediate bond coat then undergoes a heat treatment process that exposes the intermediate bond coat to an elevated temperature for a sufficient duration to cause the entrained carrier gas to expand and diffuse through the deposited material, thereby forming larger pockets within the deposited material (step 26). Examples of suitable elevated temperatures for the heat treatment process range from about 980° C. (about 1800° F.) to about 1200° C. (about 2200° F.), with particularly suitable elevated temperatures ranging from about 1040° C. (about 1900° F.) to about 1150° C. (about 2100° F.), and with even more particularly suitable elevated temperatures ranging from about 1,060° C. (about 1950° F.) to about 1100° C. (about 2000° F.). Suitable durations for the heat treatment process generally depend on the elevated temperature used, and may range from about one hour to about ten hours, with particularly suitable durations ranging from about two hours to about five hours. An example of a particularly suitable heat treatment process includes an elevated temperature of about 1080° C. (about 1975° F.) for a duration of about four hours. The heat treatment process may also cause one or more portions of the intermediate bond coat to interdiffuse with substrate 12, thereby forming a diffusion bond between substrate 12 and bond coat 14.

The heat treatment process is desirably performed in a non-oxidative atmosphere, and may be performed under reduced pressure or vacuum conditions. Examples of suitable pressures for performing the heat treatment process include about 13 millipascals (about $10^{-4}$ Torr) or less, with more particularly suitable pressures including about 1.3 millipascals (about $10^{-5}$ Torr) or less. In alternative embodiments, the diffusion bonding process may be performed in an insert gas atmosphere, such as helium, nitrogen, argon, and combinations thereof.

After the heat treatment process is complete, the resulting bond coat 14 has a porous structure due to the diffusion of the carrier gas. Suitable levels of porosity include those discussed above. Thermal barrier coating 16 is then formed on bond coat 14 to provide additional protection against the exposure to the extreme temperatures in the gas turbine engine (step 28). As discussed above, thermal barrier coating 16 may be formed by depositing a zirconia-based material with a variety of deposition techniques. After thermal barrier coating 16 is formed, turbine engine component 10 may then undergo one or more post-coating operations, and may then be installed in a gas turbine engine. For example, turbine engine component 10 may undergo a second heat treatment process after thermal barrier coating 16 is formed. Examples of suitable conditions for the second heat treatment process include those discussed above for the heat treatment process in step 26 of method 10. The use of bond coat 14 provides thermal and oxidation protection for substrate 12, thereby extending the service life of turbine engine component 10.

Figure 3:
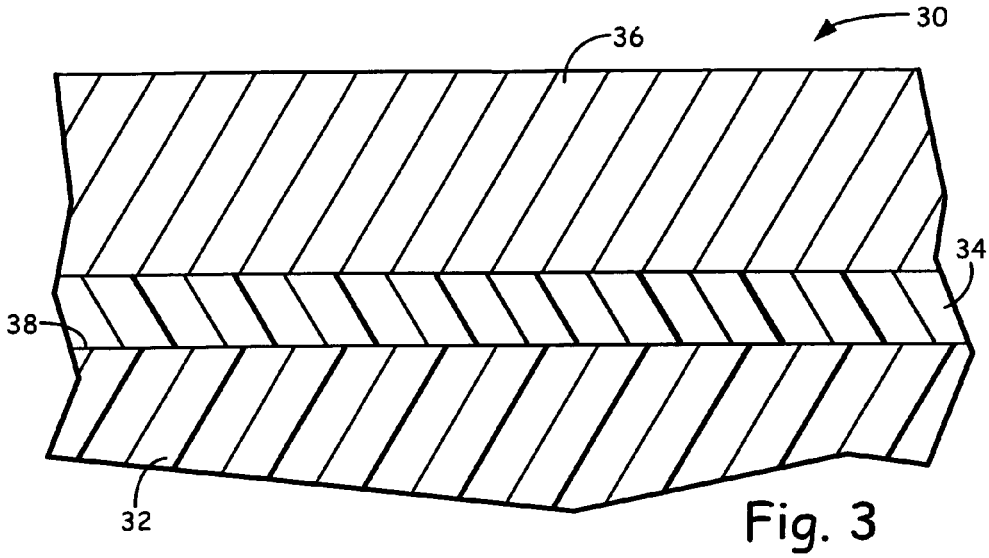
FIG. 3 is a sectional view of a turbine engine component including an intermediate bond coat and a thermal barrier coating.
Figure 4:
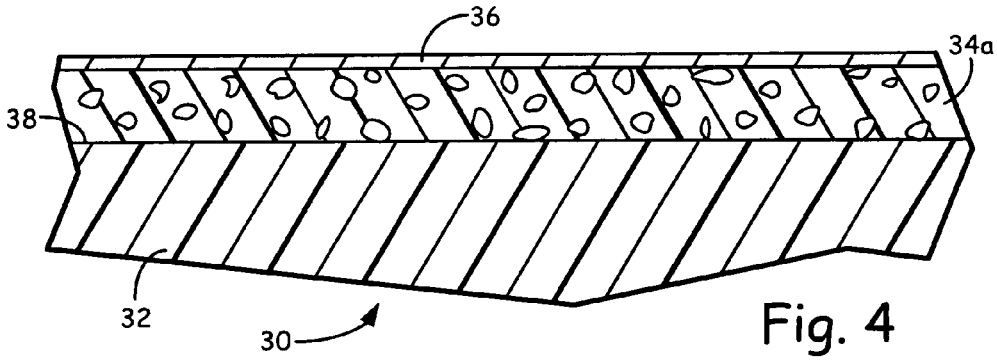
FIG. 4 is a sectional of the turbine engine component shown in FIG. 3, which includes a porous bond coat and a partially-removed thermal barrier coating.

FIGS. 3 and 4 are sectional views of turbine engine component 30, which illustrate an alternative embodiment for forming a porous bond coat on a substrate. As shown in FIG. 3, turbine engine component 30 includes substrate 32, intermediate bond coat 34, and thermal barrier coating 36. Substrate 32 is a base portion of turbine engine component 30, and include surface 38. Suitable materials for substrate 32 may depend on the function of turbine engine component 30, and examples of suitable materials for substrate 32 include those discussed above for substrate 12 (shown in FIG. 1).

Intermediate bond coat 34 is a coating deposited on surface 38 with a cold spray operation, and is the same as the intermediate bond coat discussed above in step 24 of method 20 (shown in FIG. 2) prior to the heat treatment process. In comparison to the embodiment discussed above, intermediate bond coat 34 is not exposed to a heat treatment process before thermal barrier coating 36 is formed. As such, intermediate bond coat 34 is a dense coating with small pockets of the carrier gas entrained within a matrix of the deposited material. Suitable porosity levels for intermediate bond coat 34 include porosity levels of less than about 5% by volume of intermediate bond coat 34. Suitable materials and coating thicknesses for intermediate bond coat 34 include those discussed above for bond coat 14 (shown in FIG. 1).

Thermal barrier coating 36 is a ceramic coating that thermally insulates substrate 30 and intermediate bond coat 34 during the course of operation in a gas turbine engine. Suitable materials and coating thicknesses for thermal barrier coating 36 include those discussed above for thermal barrier coating 16 (shown in FIG. 1). Thermal barrier coating 16 may also be formed using a variety of deposition techniques, such as electron beam-physical vapor deposition (EB-PVD), plasma spray, chemical vapor deposition, and cathodic arc deposition.

FIG. 4 shows turbine engine component 30 after being subjected to high temperatures and pressures in a gas turbine engine (not shown). As shown, thermal barrier coating 36 has a reduced thickness, and intermediate bond coat 34 (shown in FIG. 3) is rendered porous to form bond coat 34*a*. During operation in the gas turbine engine, turbine engine component 30 is exposed to extreme temperatures and pressures in the same manner as discussed above. Exposure to these extreme conditions eventually causes one or more portions of thermal barrier coating 36 to wear away due to spalling and/or abrasive conditions, thereby reducing the thickness of thermal barrier coating 36. As the thickness of thermal barrier coating 36 decreases, the temperature that intermediate bond coat 34 is exposed to correspondingly increases. As this process continues, the temperature that intermediate bond coat 34 is exposed to eventually reaches an elevated temperature (e.g., at least about 980° C. (about 1800° F.)) that causes the entrained carrier gases to diffuse through the material of intermediate bond coat 34, thereby forming larger pockets within the material.

The increased porosity correspondingly reduces the thermal conductivity of intermediate bond coat 34 until substantially all of the carrier gas diffuses through the material, thereby forming bond coat 34*a* with a high level of porosity. Examples of suitable levels of porosity for bond coat 34*a* include those discussed above for bond coat 14 (shown in FIG. 1). The porosity of bond coat 34*a* reduces the thermal conductivity of bond coat 34*a*, thereby reducing the amount of thermal energy transferred to substrate 32. This correspondingly reduces the amount of thermal degradation that substrate 32 undergoes, thereby extending the service life of turbine engine component 10. Additionally, despite the porosity, bond coat 34*a* also retains about 85% to about 90% of the oxidation resistance exhibited by intermediate bond coat 34. As such, bond coat 34*a* may also continue to protect substrate 32 against oxidation during the course of operation.

Figure 5:
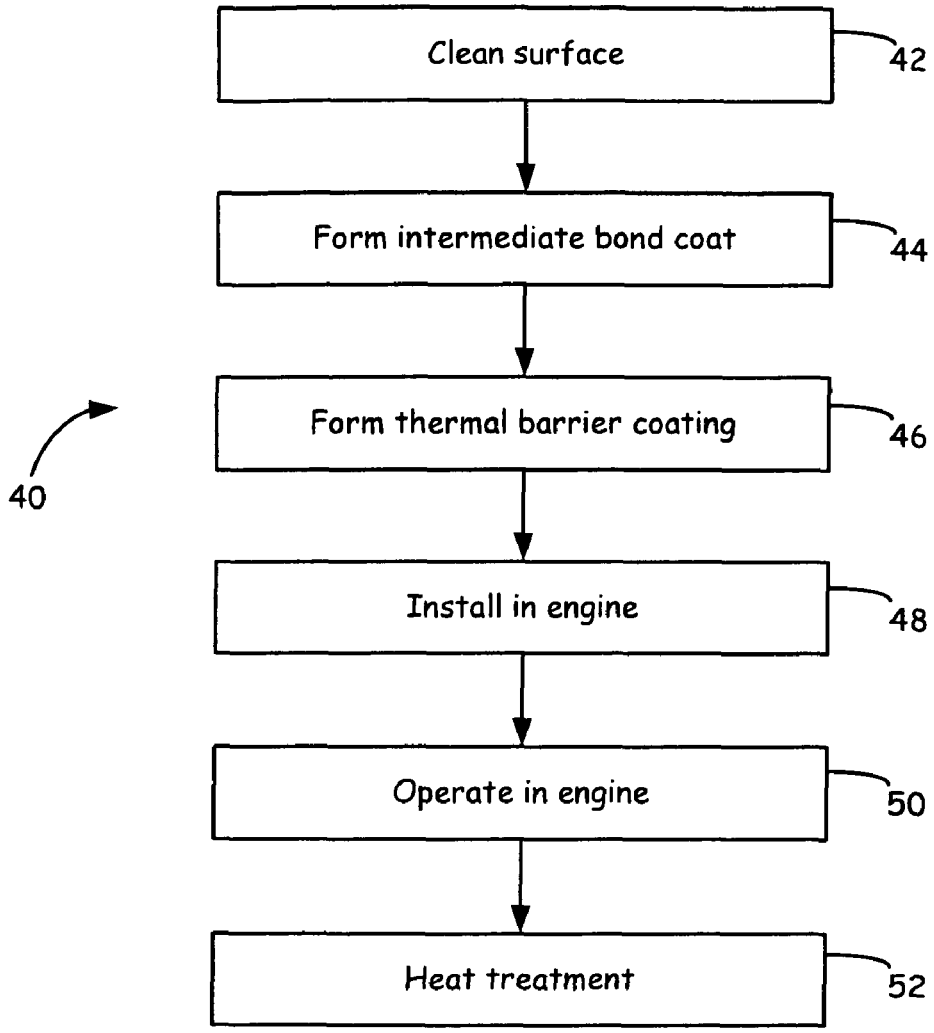
FIG. 5 is a flow diagram of a method for forming a porous bond coat and a thermal barrier coating on a turbine engine component, where the bond coat is rendered porous after forming the thermal barrier coating.

FIG. 5 is a flow diagram of method 40 for forming a porous bond coat on a turbine engine component, which is an alternative to method 20 (shown in FIG. 2). The following discussion of method 40 is made with reference to turbine engine component 30 (shown in FIGS. 3 and 4) with the understanding that method 40 is suitable for use in coating a variety of different turbine engine components. As shown, method 40 includes step 42-52, and initially involves cleaning surface 38 of turbine engine component 30 (step 42). Examples of suitable cleaning techniques for step 42 include fluoride-ion treatments with hydrogen fluoride gas. In one embodiment, method 40 is a restoration process, where substrate 32 is an engine-run component that has undergone repair and requires a replacement coating.

After surface 38 is cleaned, intermediate bond coat 34 is then formed on surface 38 with a cold spray process that deposits a powder material with a carrier gas (step 44). The cold spray process uses the carrier gas to deposit the powder material under high pressures, thereby plastically deforming the particles of the powder material in a solid state manner. This bonds the powder material to surface 36 of turbine engine component 30. Examples of suitable systems, powder materials, and processing conditions include those discussed above in step 24 of method 20 (shown in FIG. 2). Upon being deposited with the cold spray process, the deposited material provides intermediate bond coat 34, which is a dense coating containing small pockets of the carrier gas entrained within a matrix of the deposited material. Accordingly, intermediate bond coat 34 has a porosity level of less than about 5% by volume of intermediate bond coat 34.

Thermal barrier coating 36 is then formed on intermediate bond coat 34 to provide additional protection against the exposure to the extreme temperatures in the gas turbine engine (step 46). As discussed above, thermal barrier coating 36 is formed prior to subjecting intermediate bond coat 34 to a heat treatment process, and may be formed using a variety of deposition techniques. After thermal barrier coating 36 is formed, turbine engine component 30 may then undergo one or more post-coating operations. For example, turbine engine component 30 may undergo an initial heat treatment process after thermal barrier coating 36 is formed. Examples of suitable conditions for the initial heat treatment process include those discussed above for the heat treatment process in step 26 of method 10 (shown in FIG. 2).

Turbine engine component 30 is then installed (step 48) and operated in a gas turbine engine (step 50). During initial operations of the gas turbine engine, thermal barrier coating 36 prevents intermediate bond coat 34 from being exposed to elevated temperatures that are great enough to cause the entrained carrier gas to diffuse through the material of intermediate bond coat 34. However, over extended periods of operation, successive portions of thermal barrier coating 36 are removed due to spalling and/or abrasive conditions. As the successive portions of thermal barrier coating 36 are removed, the temperature that intermediate bond coat 34 is exposed to increases. Eventually, the temperature reaches a point in which intermediate bond coat 34 undergoes a heat treatment process (step 52). In the heat treatment process, the elevated temperatures of the gas turbine engine cause one or more portions of the entrained carrier gases to diffuse through the material of intermediate bond coat 34, thereby forming larger pockets within the material.

The increased porosity correspondingly reduces the thermal conductivity of intermediate bond coat 34 until substantially all of the carrier gas fully diffuses through the material, thereby forming bond coat 34*a* with a high level of porosity. As discussed above, the porosity of bond coat 34*a* reduces the thermal conductivity of bond coat 34*a*, thereby reducing the amount of thermal energy transferred to substrate 32. This correspondingly reduces the amount of thermal degradation that substrate 32 undergoes. As a result, the use of bond coat 34*a* provides thermal and oxidation protection for substrate 32, thereby extending the service life of turbine engine component 30 while installed in the gas turbine engine.

The above-discussed embodiments illustrate the use of the porous metallic coatings as bond coats (i.e., bond coat 14 and intermediate bond coat 34) for thermal barrier coatings (i.e., thermal barrier coatings 16 and 36). In alternative embodiments, a variety of different overcoats may be formed over bond coat 14 and intermediate bond coat 34. Additionally, bond coat 14 and intermediate bond coat 34 may be stand-alone coatings without subsequent overcoats. In these embodiments, the stand-alone coatings may directly provide thermal and oxidation resistance to underlying substrates.

Although the present invention has been described with reference to preferred embodiments, workers skilled in the art will recognize that changes may be made in form and detail without departing from the spirit and scope of the invention.

The invention claimed is:

1. A turbine engine component prior to being installed in an operating turbine engine, comprising:

a substrate of the turbine engine component having a surface;

a bond coating formed on the surface of the substrate from a metal-based material with a cold spray process using a carrier gas, the bond coat containing entrained carrier gas and having substantially no pores; and a thermal barrier coating formed on the surface of the bond coat without causing the entrained carrier gas in the bond coat to form pores, the thermal barrier coating being adapted to be worn away during operation of the engine to expose the bond coating to a temperature of from about 980° C. (about 1800° F.) to about 1200° C. (about 2200° F.), to cause the entrained carrier gas to form pores in the bond coating so that the exposed bond coating has a level of porosity ranging from about 20% by volume of the coating to about 50% by volume of the coating.

2. The turbine engine component of claim 1, wherein the level of porosity ranges from about 25% by volume of the coating to about 45% by volume of the coating.

3. The turbine engine component of claim 2, wherein the level of porosity ranges from about 30% by volume of the coating to about 40% by volume of the coating.

4. The turbine engine component of claim 1, wherein the metal-based material is selected from the group consisting of aluminum, transition metals, MCrAlY materials, and combinations thereof.

5. The turbine engine component of claim 1, wherein the thermal barrier coating disposed over the bond coat is a zirconiea material modified with a stabilizer.

6. The turbine engine component of claim 5, wherein the stabilizer is selected from the group consisting of yttria, calcia, ceria, magnesia and mixtures thereof.

7. A turbine engine component prior to being installed in an operating turbine engine, comprising:

a substrate of the turbine engine component having a surface;

a thermal barrier coating formed on the substrate, the thermal barrier coating being adapted to be worn away during operation of the engine; and a bond coating positioned between the surface of the substrate and the thermal barrier coating, the bond coat containing entrained carrier gas and having substantially no pores after being positioned between the surface and the coating, the bond coating being capable of transforming from having substantially no pores to a level of porosity ranging from about 20% by volume of the coating to about 50% by volume of the coating when exposed to a temperature of from about 980° C. (about 1800° F.) to about 1200° C. (about 2200° F.) as a result of the thermal barrier coating being worn away.

8. The turbine engine component of claim 7, wherein the level of porosity ranges from about 30% by volume of the coating to about 40% by volume of the coating.

9. The turbine engine component of claim 7, wherein the bond coat is selected from the group consisting of aluminum, transition metals, MCrAlY materials, and combinations thereof.

10. The turbine engine component of claim 7, wherein the thermal barrier coating disposed over the bond coat is a zirconiea material modified with a stabilizer.

11. The turbine engine component of claim 10, wherein the stabilizer is selected from the group consisting of yttria, calcia, ceria, magnesia and mixtures thereof.

12. A turbine engine component prior to being installed in an operating turbine engine, comprising:

a substrate of the turbine engine component having a surface; and a bond coating formed on the surface of the substrate from a metal-based material with a cold spray process using a carrier gas and having entrained carrier gas, the bond coat having a porosity less than about 5% by volume of the entire bond coat, the metal-based material is selected from the group consisting of aluminum, transition metals, MCrAlY materials, and combinations thereof; and a zirconia material modified with a stabilizer forming a thermal barrier coating formed on the surface of the bond coat without causing the entrained carrier gas in the bond coat to form pores, the thermal barrier coating being adapted to be worn away during operation of the engine such that the bond coating is exposed to a temperature of from about 980° C. (about 1800° F.) to about 1200° C. (about 2200° F.), wherein the bond coating after being exposed to heat has a level of porosity ranging from about 25% by volume of the coating to about 45% by volume of the coating.

13. The turbine engine component of claim 12, wherein the stabilizer is selected from the group consisting of yttria, calcia, ceria, magnesia and mixtures thereof.

* * * * *